US007050023B2

(12) United States Patent
Ogawa et al.

(10) Patent No.: US 7,050,023 B2
(45) Date of Patent: May 23, 2006

(54) DISPLAY DEVICE WITH CONTROLLED DRIVING SOURCE

(75) Inventors: Takashi Ogawa, Gifu (JP); Yoshinori Saito, Konan (JP); Hitoshi Yasuda, Gifu (JP); Ryuji Nishikawa, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 277 days.

(21) Appl. No.: 10/382,984

(22) Filed: Mar. 7, 2003

(65) Prior Publication Data

US 2003/0222834 A1 Dec. 4, 2003

(30) Foreign Application Priority Data

Mar. 8, 2002 (JP) ..... 2002-063982

(51) Int. Cl.
*G09G 3/30* (2006.01)

(52) U.S. Cl. ..... 345/77; 345/78; 315/169.3

(58) Field of Classification Search ..... 345/76–83, 345/690–691; 315/169.3
See application file for complete search history.

(56) References Cited

U.S. PATENT DOCUMENTS

| | | | | |
|---|---|---|---|---|
| 5,903,246 | A * | 5/1999 | Dingwall | 345/82 |
| 6,204,610 | B1 * | 3/2001 | Komiya | 315/169.3 |
| 6,580,409 | B1 * | 6/2003 | Ito et al. | 345/76 |
| 6,738,034 | B1 * | 5/2004 | Kaneko et al. | 345/76 |
| 6,771,243 | B1 * | 8/2004 | Hirohata | 345/89 |

* cited by examiner

*Primary Examiner*—Amr A. Awad
(74) *Attorney, Agent, or Firm*—Morrison & Foerster LLP

(57) ABSTRACT

The upper limit $V_H$ of the driving voltage PVdd is set in such way that the brightness of an organic EL element is lower than the first standard brightness L1 when the video signal Dm is at the black signal level (V0), in an EL display device with the driving source for driving the organic EL element. Also, the lower limit $V_L$ of the driving voltage PVdd is set in such way the brightness of the organic EL element is higher than the second standard brightness L2 when the video signal Dm is at the white signal level (V1). The electroluminescent display device displays black and white with a proper contrast.

4 Claims, 2 Drawing Sheets

DISPLAY DEVICE WITH CONTROLLED DRIVING SOURCE

BACKGROUND OF THE INVENTION

1. Field of the Invention

This invention relates to a display device, especially to an electroluminescent display device with an electroluminescent element and a thin film transistor provided for each of display pixels.

2. Description of the Related Art

Display devices with an electroluminescent (referred to as EL hereinafter) element have been gathering attention as a display device substituting a CRT or an LCD. The development efforts for the EL display device with a thin film transistor (referred to as TFT hereinafter) as a switching element for driving the EL element have been made accordingly.

FIG. 3 is an equivalent circuit diagram of a display pixel of an EL display device with an EL element and a TFT. A plurality of the display pixels is disposed in a matrix configuration in an actual EL display device.

FIG. 3 is an equivalent circuit diagram of the EL display device having a first TFT 100, a second TFT 110 and the organic EL element 120, and shows only one display pixel of the matrix, which is located near the crossing of a gate signal line 50 at the n-th row and a drain signal line 60 at the m-th column.

The gate signal line, which supplies a gate signal Gn, and the drain signal line 60, which supplies a drain signal that is a video signal Dm, intersect each other. The organic EL element 120, the TFT 110 for driving the organic EL element, and the TFT 110 for selecting the display pixel are disposed near the crossing of these two signal lines.

A driving source 105, from which a positive driving voltage PVdd is supplied, is connected to a drain 100*d* of the first TFT 100 for driving the organic EL element. A source 100*s* is connected to an anode 121 of the organic EL element.

A gate 110*g* of the second TFT 110 for selecting the display pixel is connected to the gate signal line 50, receiving the gate signal Gn, and a drain 110*d* of the second TFT 110 is connected to the drain signal line 60, receiving the video signal Dm. A source 110*s* of the second TFT110 is connected to a gate 100*g* of the first TFT100. The gate signal Gn is outputted from a gate driver circuit not shown in the figure. The video signal Dm is outputted from a drain driver circuit not shown in the figure.

The organic EL element 120 includes the anode 121, a cathode 122, and a emission layer 123 disposed between the anode 121 and the cathode 122. The cathode 122 is connected to a common source 140 that supplies a negative common voltage.

A storage capacitance element 130 is connected to the gate 100*g* of the first TFT 100. That is, one of the electrodes of the storage capacitance element 130 is connected to the gate 100*g*, and the other electrode is connected to a storage capacitance electrode 131. The storage capacitance element 130 is provided in order to hold the video signal of the display pixel for one field period by keeping the charge corresponding to the video signal Dm.

The operation of the EL display device with the above configuration is as follows. The second TFT 100 turns on when the gate signal Gn becomes high-level for one horizontal period. Then, the video signal Dm is applied to the gate 100*g* of the first TFT 100 from the drain signal line 60 through the second TFT 110. The conductance of the first TFT 110 changes in response to the video signal Dm supplied to the gate 100*g*, and a driving current corresponding to the changed conductance is supplied to the organic EL element 120 from the driving source 105 through the first TFT 100. This controls the brightness of the organic EL element 120.

As described above, the brightness of the organic EL element 120 is controlled based on the conductance of the first TFT 100, which changes in response to the video signal Dm. However, conventional EL display devices lack an appropriate contrast in its display presentation.

SUMMARY OF THE INVENTION

The invention provides a display device having a plurality of display pixels. Each of the display pixels includes an electroluminescent element and a first thin film transistor. The source of the first thin film transistor is connected to the electroluminescent element. The display pixel also includes a driving source supplying a driving voltage to the drain of the first thin film transistor, and a second thin film transistor receiving a video signal at its drain and supplying the video signal to the gate of the first thin film transistor in response to a gate signal. In this configuration, the upper limit of the driving voltage is determined so that a brightness of the electroluminescent element is lower than a first standard brightness when the video signal is at a black signal level, and the lower limit of the driving voltage is determined so that the brightness of the electroluminescent element is higher than a second standard brightness when the video signal is at a white signal level.

DETAILED DESCRIPTION OF THE INVENTION

An embodiment of this invention will be described in detail by referring to FIGS. 1–3. The configuration of an EL display device of this embodiment is the same as that shown in FIG. 3 in terms of the equivalent circuit. The first TFT 100 is a P-channel type and the second TFT 110 is an N-channel type in the description below.

Figure 1:
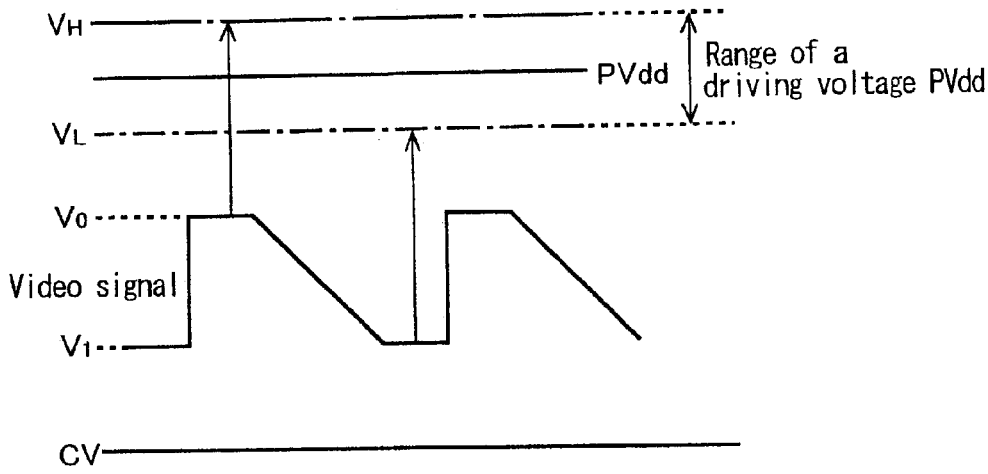
FIG. 1 is to explain the setting of the driving voltage PVdd in the EL display device of an embodiment of this invention.

FIG. 1 shows a setting of a driving voltage PVdd in the EL display device of this embodiment. A video signal Dm, which is supplied from a drain signal line 60 through the second TFT 110, changes between a white signal level (V1) and a black signal level (V0). The black signal level (V0) is greater than the white signal level (V1).

When a high level Gn (H) of a gate signal Gn supplied from a gate signal line 50 is higher by a certain amount than the black signal level (V0) of the video signal Dm, the video signal Dm will be supplied to a gate 100*g* of the first TFT100 with its level kept unchanged. This condition is expressed as follows:

$$Gn(H) \geqq V0 + Vth.$$

Here, Vth is a threshold voltage of the second TFT 110. However, this condition is not the only condition used in this embodiment. For example, the following condition is also applicable to this embodiment:

$$Gn(H)<V0+Vth \text{ and } Gn(H)\geqq Vth.$$

Suppose the video signal Dm is at the black signal level (V0). The black signal level (V0) is supplied unchanged to the gate 100*g* of the first TFT 100 when Gn(H)≧ V0+Vth. A small amount of current corresponding to the signal level goes through the first TFT 100, and is supplied to an organic EL element 120. Here, the brightness of the organic EL element 120 should be dark enough to be recognized as the black display. Ideally, the first TFT 100 should be completely off and the brightness should be 0 cd/m$^2$.

However, the first TFT 100 turns on and the current starts going through when the driving voltage PVdd is above a certain level. Then, the brightness of the organic EL element 120 increases, decreasing the contrast of the EL display. A first standard brightness L1 of the organic EL element 120 is an upper limit of the brightness for black representation to sustain a proper contrast. The driving voltage PVdd when the brightness of the organic EL element is at the first standard brightness L1 is set as the upper limit voltage $V_H$ of the driving voltage PVdd.

The voltage of the black signal level supplied to the gate 100*g* of the first TFT 100 decreases to Gn(H)−Vth, when Gn(H)<V0+Vth. The upper limit voltage $V_H$ of the driving voltage PVdd is set according to this decreased voltage.

Suppose the video signal Dm is at the white signal level (V1) and Gn(H)≧V1+Vth. The white signal level (V1) is supplied to the gate 100*g* of the first TFT 100, turning the first TFT 100 on. The large amount of current in response to the signal level goes through the first TFT 100, and is supplied to the organic EL element 120. Here, the brightness of the organic EL element 120 should be bright enough to be recognized as white representation.

However, when the driving voltage PVdd is too low, the brightness of the organic EL element decreases due to the decrease in the current going through the first TFT 100, deteriorating the contrast of the EL display. A second standard brightness L2 of the organic EL element 120 is an lower limit of the brightness for white representation to sustain a proper contrast. The driving voltage PVdd when the brightness of the organic EL element is at the second standard brightness L2 is set as the lower limit voltage $V_L$ of the driving voltage PVdd.

Therefore, an adequate limits of the driving voltage PVdd for an appropriate contrast between the white and black representations of the EL display is as follows:

$$V_L \leqq PVdd \leqq V_H.$$

Next, the limits of the driving voltage PVdd will be described based on the results of experiment conducted by the inventors. FIG. 2 shows the relationship between the driving voltage PVdd and the brightness of the organic EL element. A negative common voltage CV supplied from a common source 140 to the organic EL element 120 is −7V. Also, the white signal level (V1) is 1V and the black signal level (V0) is 5V.

Figure 2:
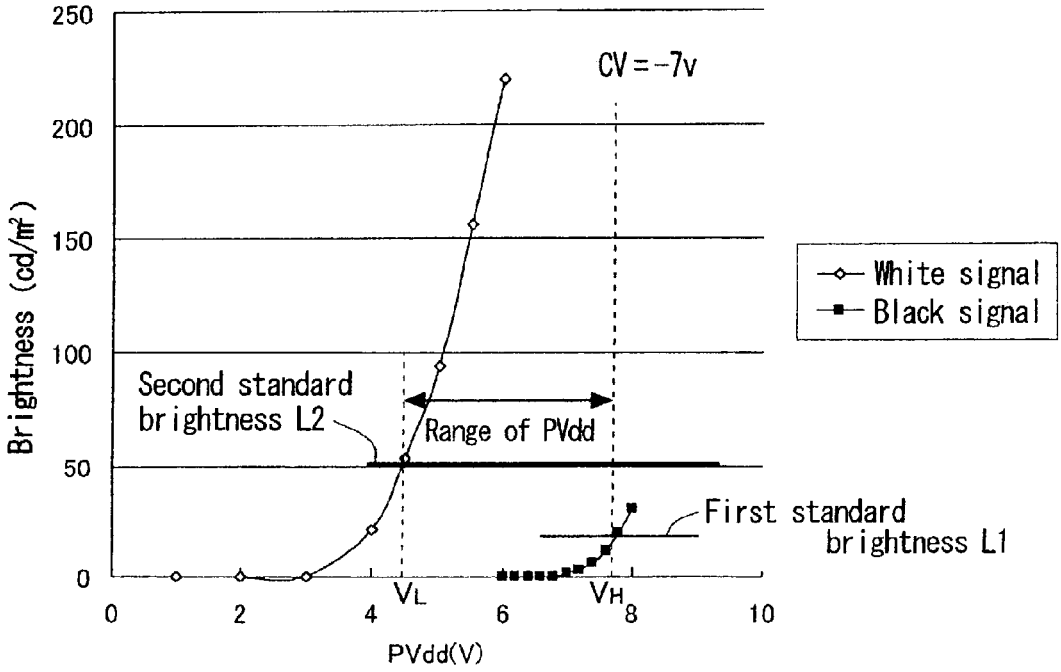
FIG. 2 shows the relationship between the driving voltage PVdd and the brightness of the organic EL element of an embodiment of this invention.
Figure 3:
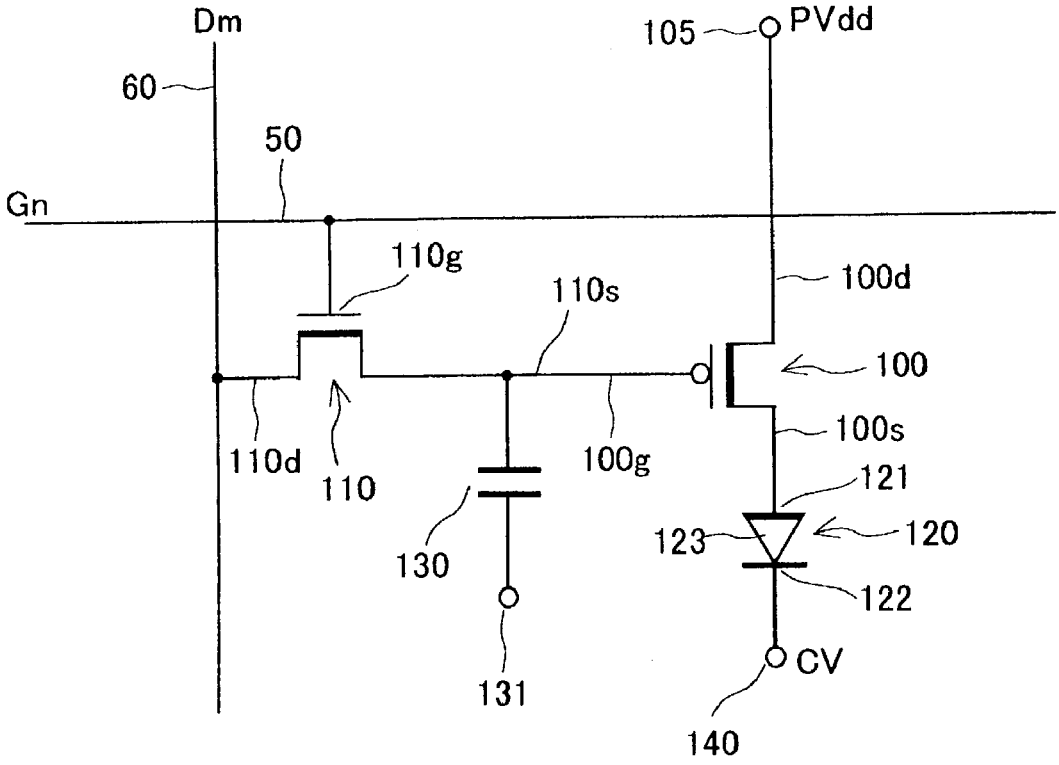
FIG. 3 is an equivalent circuit diagram showing one display pixel of the EL display device with the EL element and the TFT.

Although the organic EL element provides a low brightness when receiving the black signal, the brightness gradually increases when the driving voltage PVdd is above 7V, as shown in FIG. 2. In this embodiment, the first standard brightness L1 is 20 d/cm$^2$, as shown in FIG. 2. On the other hand, although the organic EL element provides a high brightness when receiving the white signal, the brightness gradually decreases as the driving voltage PVdd decreases. In this embodiment, the second standard brightness L2 is 50 cd/m$^2$, as shown in FIG. 2.

Thus, the proper driving voltage PVdd is between 4.5V and 7.7V according to the first and second standard brightness L1, L2. Although the values of the first and second standard brightness L1, L2 described above are preferable, this invention is not limited to these values, and other values may be applicable according to the configuration of the EL display device. Likewise, the white signal level and the black signal level may be altered accordingly.

The range of the driving voltage PVdd is determined based on the relationship between the driving voltage PVdd and the brightness of the organic EL element at room temperature in this embodiment. However, since the brightness of the organic EL element may depend on the temperature, it may be necessary to determine the range of the driving voltage PVdd by taking the temperature change into consideration.

The first TFT100 is a P-channel type and the second TFT 110 is an N-channel type in this embodiment. However, this invention is not limited to that configuration, and the first TFT 100 may be an N-channel type and the second TFT 110 may be a P-channel type.

The white signal level and the black signal level of the video signal Dm should be reversed when the first TFT 100 for driving is an N-channel type. That is, the black signal level (V0) is lower than the white signal level (V1). This invention can also be applied to the EL display device with such a configuration.

The upper limit $V_H$ and the lower limit $V_L$ of the driving voltage PVdd are determined, in this embodiment, based on the fact that the driving voltage and the white and black signal levels of the video signal affect the brightness of the electroluminescent element. The adequate contrast between the white and black representation of the EL display device is achieved by setting the upper limit and the lower limit of the driving voltage PVdd within a pre-determined range.

What is claimed is:

1. A display device having a plurality of display pixels, each of the display pixels comprising:

an electroluminescent element;

a first thin film transistor, a source of the first thin film transistor being connected to the electroluminescent element;

a driving source supplying a driving voltage to a drain of the first thin film transistor; and a second thin film transistor receiving a video signal at a drain thereof and supplying the video signal to a gate of the first thin film transistor in response to a gate signal;

wherein an upper limit of the driving voltage is determined so that a brightness of the electroluminescent element is lower than a first standard brightness when the video signal is at a black signal level and turns on the first thin film transistor, and a lower limit of the driving voltage is determined so that the brightness of the electroluminescent element is higher than a second standard brightness when the video signal is at a white signal level.

2. The display device of claim 1, wherein the first standard brightness is equal to or lower than 20 cd/m $^2$.

3. The display device of claim 1, wherein the second standard brightness is equal to or higher than 50 cd/m $^2$.

4. The display device of claim 1, wherein the first thin film transistor is a P-channel type thin film transistor, and the black signal level of the video signal is higher than the white signal level of the video signal.

* * * * *